US007245865B2

(12) United States Patent
Iwakura et al.

(10) Patent No.: US 7,245,865 B2
(45) Date of Patent: Jul. 17, 2007

(54) TRANSFER APPARATUS AND IMAGE FORMING APPARATUS

(75) Inventors: Yoshie Iwakura, Higashiosaka (JP); Susumu Murakami, Souraku-gun (JP); Kuniaki Nakano, Souraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 7 days.

(21) Appl. No.: 11/052,980

(22) Filed: Feb. 7, 2005

(65) Prior Publication Data

US 2005/0185992 A1 Aug. 25, 2005

(30) Foreign Application Priority Data

Feb. 19, 2004 (JP) ..... 2004-043341

(51) Int. Cl.
*G03G 15/01* (2006.01)

(52) U.S. Cl. ..... 399/302; 399/66; 399/308

(58) Field of Classification Search ..... 399/302, 399/314, 299, 310
See application file for complete search history.

(56) References Cited

U.S. PATENT DOCUMENTS

| | | | | |
|---|---|---|---|---|
| 4,873,541 | A | 10/1989 | Hirose et al. | |
| 6,006,062 | A * | 12/1999 | Takahashi et al. | 399/310 |
| 6,173,148 | B1 * | 1/2001 | Matsuda et al. | 399/310 |
| 6,282,386 | B1 * | 8/2001 | Ishii | 399/66 |
| 6,377,771 | B1 * | 4/2002 | Verluyten et al. | 399/302 |
| 6,416,873 | B1 * | 7/2002 | Hara et al. | 428/473.5 |
| 6,449,453 | B1 * | 9/2002 | Motohashi | 399/302 |
| 6,618,565 | B2 | 9/2003 | Tamiya et al. | |
| 6,829,450 | B2 * | 12/2004 | Tamiya et al. | 399/66 |
| 2004/0179872 | A1 * | 9/2004 | Saito et al. | 399/302 |

FOREIGN PATENT DOCUMENTS

| | | |
|---|---|---|
| JP | 64-040847 | 2/1989 |
| JP | 2574804 | 10/1996 |
| JP | 10-39651 | 2/1998 |
| JP | 10-293437 | 11/1998 |
| JP | 2003-035986 | 2/2003 |

* cited by examiner

*Primary Examiner*—David M. Gray
*Assistant Examiner*—Bryan Ready
(74) *Attorney, Agent, or Firm*—David G. Conlin; David A. Tucker; Edwards Angell Palmer & Dodge LLP

(57) ABSTRACT

A transfer apparatus and an image forming apparatus capable of transferring an image satisfactorily using developing agent are disclosed. A transfer system includes photosensitive drums corresponding to the respective colors arranged along the outer peripheral surface of a transfer belt and intermediate transfer rollers arranged offset downstream side from the respective photosensitive drums for applying a transfer field to the respective photosensitive drums. The transfer belt is configured of a material such as polyimide or polycarbonate in which a surge current of not less than a specified value flows immediately after application of a transfer voltage.

12 Claims, 6 Drawing Sheets

TRANSFER BELT:PAA

TRANSFER APPARATUS AND IMAGE FORMING APPARATUS

CROSS-REFERENCE TO RELATED APPLICATIONS

This nonprovisional application claims priority under 35. U.S.C. §119(a) on Patent Application No. 2004-043341 filed in Japan on Feb. 19, 2004, the entire contents of which are hereby incorporated by reference.

BACKGROUND OF THE INVENTION

1. Field of the Invention

The present invention relates to a transfer apparatus and an image forming apparatus which form images by an electrophotographic method using developing agent transferred onto a transfer material (for example, a paper) with a transfer belt.

2. Description of Related Art

In recent years, demand has increased to form a full-color image as well as a monochromatic image by an image forming apparatus of electrophotographic type, and such an electrophotographic full-color image forming apparatus is under development. Normally, the full-color image forming apparatus forms images using color toner (developing agent) corresponding to each image data of a plurality of colors decomposed from a color image. For example, the same color image is read through each of the filters of each color (red, green, blue) of the three primary colors for additive color mixture, and an image data of each color (cyan, magenta, yellow) of at least the three primary colors for subtractive color mixture is created from the read data. Based on the image data of each color, a visible image is generated using toner of the corresponding color, and these visible images of the respective colors are superposed one on another thereby to form a full-color image.

In this full-color image forming apparatus, the exposure process, the development process and the transfer process are required for each color, while at the same time occurring the problem of aligning the visible images of the respective colors in position. In view of this situation, the rate at which the full-color image is formed is apparently considered lower than the rate at which the monochromatic image is formed. To overcome this problem, a full-color image forming apparatus of tandem type has conventionally been proposed in which a plurality of image forming units for forming visible images of different colors are arranged in line on the outer peripheral surface of a rotatable semiconductive endless belt along the direction of movement thereof, so that a full color image may be formed before the endless belt makes at least one rotation.

To increase the speed of forming a full-color image, the full-color image forming apparatus of tandem type employs an intermediate transfer method in which the visible images of the respective colors formed in the image forming units are superposed one on another on the outer peripheral surface of the endless belt and then transferred onto the paper, or a transfer conveyance method in which the visible images of the respective colors formed by the image forming units are transferred sequentially onto the surface of a transfer material (for example, a paper) conveyed by adsorption on the outer peripheral surface of the endless belt (for example, Japanese Patent Application Laid-Open No. 10-039651 (1998) and Japanese Patent Application Laid-Open No. 10-293437 (1998) and Japanese Patent No. 2574804).

FIG. 1 is a schematic diagram for explaining the configuration of the essential portion of the conventional full-color image forming apparatus employing the intermediate transfer method. The full-color image forming apparatus shown in FIG. 1 comprises an image forming unit 200 of electrophotographic type, in which a full-color image is formed on the paper through a primary transfer process for transferring the toner images of the respective colors in superposed relation with each other on a transfer belt 201 and a secondary transfer process for transferring onto the paper the multi-color toner image formed on the transfer belt 201 in the primary transfer process. The transfer belt 201 is configured to move along the direction of the white arrow by a transfer belt driving roller 202 and a transfer belt driven roller 203. Photosensitive drums 204*a* through 204*d* corresponding to the respective colors (for example, yellow, magenta, cyan and black) and intermediate transfer rollers 205*a* through 205*d* in opposed relation to the photosensitive drums 204*a* through 204*d*, respectively, are arranged along the path of the transfer belt 201.

In such conventional full-color image forming apparatus, consider a case in which an image is printed based on the image data inputted from the external. First, the electrically charged toner images of the respective colors are formed on the surface of the respective photosensitive drums 204*a* through 204*d*. Then, high-voltage transfer bias is applied to the intermediate transfer rollers 205*a* through 205*d*, so that the toner images on the photosensitive drums 204*a* through 204*d* are sequentially transferred onto the transfer belt 201. In the process, the transfer timing of the respective toner images is controlled, so that the toner images of the respective colors are superposed one on another and a single multi-color toner image is formed on the transfer belt 201. Then, a high voltage of opposite polarity to the charge polarity of the toner is applied to the transfer roller 206 arranged in the subsequent stage of the primary transfer process, with the result that a multi-color toner image is transferred on the paper supplied from a paper feeding unit 210. The paper onto which the multi-color toner image has been transferred is conveyed to a fixing unit not shown, where the multi-color toner image is fixed on the paper. Thus, a printed matter formed with a full-color image is completed.

In the image forming apparatus described above, the transfer belt 201 carrying the toner image in the primary transfer process is held by the respective photosensitive drums 204*a* through 204*d* and the intermediate transfer rollers 205*a* through 205*d*, and the toner image on the photosensitive drums 204*a* through 204*d* is transferred onto the transfer belt 201 under a comparatively high pressure. As a result, with the progress of the transfer process for the respective colors, the adhesion between the toner and the transfer belt 201 is increased to such an extent that the cohesion between the toners is promoted. Thus, the resolution is reduced, and the transfer failure is liable to occur at the time of electrostatic transfer in the secondary transfer process.

In view of this, the present inventors earlier proposed an image forming apparatus (Japanese Patent Application No. 2004-43342) in which the intermediate transfer rollers 205*a* through 205*d* are arranged in spaced relation downstream side of the transfer process from the positions opposed to the photosensitive drums 204*a* through 204*d* in such a manner as to reduce the contact pressure between the transfer belt 201 and the photosensitive drums 204*a* through 204*d*. In such image forming apparatus, the increase in adhesion between the toner and the transfer belt 201 can be reduced while at the same time preventing the cohesion between the toners. Thus, the toner image can be satisfactorily transferred and a satisfactory image quality obtained in the secondary transfer process.

In the transfer system of the above mentioned image forming apparatus newly proposed by the present inventors, however, the intermediate transfer rollers and the photosensitive drums are arranged in spaced relation with each other, and a current or a voltage is applied through the transfer belt interposed between them. The toner transfer, therefore, is affected by the action corresponding to the current change characteristic or the voltage change characteristic of the transfer belt. Therefore, unlike in the prior art, the transfer performance of the primary transfer process cannot be determined simply by the guideline of the resistance value of the transfer belt, and it has become apparent that a stable toner transfer may not be conducted even with the transfer belt having the same resistance value. In order to improve the image quality, therefore, a guideline is required to select a transfer belt material applicable to the transfer system newly proposed by the present inventors, and the transfer system is required to be configured using the transfer belt formed in accordance with the guideline.

BRIEF SUMMARY OF THE INVENTION

This invention has been achieved in view of the aforementioned situation, and the object thereof is to provide a transfer apparatus and an image forming apparatus in which when a voltage is applied in the primary transfer process, the image formed by the image forming units is transferred to the transfer belt having such an electric characteristic that a surge current of a predefined value or more flows within a predetermined time, and the image transferred to the transfer belt is transferred to a transfer material. In this way, the image can be transferred satisfactorily with developing agent.

The transfer apparatus of the invention is a transfer apparatus which comprises a transfer belt having conductivity and an image forming unit pressed against the transfer belt to form an image using charged developing agent, and transfers the image formed by the image forming unit to the transfer belt by applying a voltage to the image forming units through the transfer belt in a primary transfer process, and further transfers the image transferred in the primary transfer process to the transfer material in the secondary transfer process, while the transfer belt is made to move in a predetermined direction, characterized in that the transfer belt has such electric characteristics that a surge current of not less than a predefined value flows within a predetermined time upon application of a voltage in the primary transfer process.

The transfer apparatus according to this invention uses a transfer belt having such an electric characteristic that a surge current of not less than a predefined value flows within a predetermined time upon application of a voltage in the primary transfer process, and therefore the image transfer from the image forming units to the transfer belt is made possible by the action of the surge current flowing into the transfer nip. Even in the case where the image forming units and the position where the primary transfer process is executed are spaced from each other on the transfer belt, therefore, an image is transferred satisfactorily.

The transfer apparatus of the invention is, in the above mentioned transfer apparatus, characterized in that the predetermined time is specified by the moving speed of the transfer belt and the contact width in the predetermined direction between the transfer belt and the image forming units.

The transfer apparatus according to this invention uses a transfer belt having such an electric characteristic that a surge current flows in the time predefined by the moving speed of the transfer belt and the contact width between the transfer belt and the image forming units. Therefore, the image transfer to the transfer belt is made possible by the action of the surge current flowing within the time when the transfer is to be completed, i.e. within the transfer nip time. Even in the case where the image forming units and the position at which the primary transfer process is executed are spaced from each other on the transfer belt, therefore, a satisfactory image is transferred.

The transfer apparatus of the invention is, in the above mentioned transfer apparatus, characterized in that the predetermined time is not less than 10 msec but not more than 80 msec, or more preferably not less than several msec but not more than several tens of msec.

In the transfer apparatus according to this invention, the primary transfer is executed using such a transfer belt that upon application of a voltage in the primary transfer process, a surge current flows within the time of not less than 10 msec but not more than 80 msec, or more preferably within several to several tens of msec. In the standard transfer process for an image forming apparatus employing the electrophotographic method, therefore, the image transfer is completed by the action of the surge current flowing in the transfer nip time.

The transfer apparatus of the invention is, in the above mentioned transfer apparatus, characterized in that the specified value is at least twice (or more) or four (or more) times as large as the current flowing in the transfer belt after the predetermined time.

In the transfer apparatus according to this invention, the primary transfer is executed using such a transfer belt that upon application of a voltage in the primary transfer process, a surge current at least twice or quadruple as large as the steady current flows. Therefore, the surge current flows along the surface or into the volume of the transfer belt, and the image is transferred by the action of this surge current.

The transfer apparatus of the invention is, in the above mentioned transfer apparatus, characterized in that the primary transfer process is a process for applying a voltage to a conductive roller pressed in contact with the transfer belt in spaced relation with the contact area between the transfer belt and the image forming unit.

In the transfer apparatus according to this invention, the conductive rollers are pressed against the transfer belt in spaced relation with the contact area between the transfer belt and the image forming units. Therefore, only the transfer belt is interposed between the conductive rollers and the image forming units, and the contact pressure between the conductive rollers and the image forming units is reduced. As a result, the increase in cohesion of the developing agent and the adhesion between the developing agent and the transfer belt is prevented, thereby making it possible to transfer the image satisfactorily in the secondary transfer process.

The transfer apparatus of the invention is, in the above mentioned transfer apparatus, characterized by comprising a plurality of the image forming units; and characterized in that the images formed by each of the image forming units are sequentially transferred to the transfer belt and superposed one on another thereby to form a single image on the transfer belt.

The transfer apparatus according to this invention comprises a plurality of image forming units, and the images formed by the respective image forming units are sequentially transferred to the transfer belt. A color image can be transferred, therefore, by assigning the respective image forming units to the developing agent of different colors.

The transfer apparatus of the invention is, in the above mentioned transfer apparatus, characterized in that the resistance value of the transfer belt is not less than $1\times10^{8}$ Ω but not more than $1\times10^{14}$ Ω.

In the transfer apparatus according to this invention, the resistance of the transfer belt is set at a proper value, and therefore the transfer failure in the primary and secondary transfer processes is suppressed, thereby eliminating the residual transfer potential.

The transfer apparatus of the invention is, in the above mentioned transfer apparatus, characterized in that the transfer belt is formed of polyimide or polycarbonate.

In the transfer apparatus according to this invention, the transfer belt is formed using polyimide or polycarbonate in which a surge current of not less than a predefined value flows within the transfer nip time upon application of a voltage in the primary transfer process. Even in a transfer system in which the image forming units and the position where the primary transfer process is executed are arranged in spaced relation with each other, therefore, an image can be transferred by the action of the surge current flowing in the transfer belt.

The image forming apparatus according to this invention is an image forming apparatus comprising: a communication unit for receiving image data from the external; and a transfer apparatus which comprises a transfer belt having conductivity and an image forming unit pressed against the transfer belt to form an image using charged developing agent, and transfers the image formed by the image forming unit based on the image data received by the communication unit to the transfer belt by applying a voltage to the image forming units through the transfer belt in a primary transfer process, and further transfers the image transferred in the primary transfer process to the transfer material in the secondary transfer process, while the transfer belt is made to move in a predetermined direction, characterized in that the transfer belt has such electric characteristics that a surge current of not less than a predefined value flows within a predetermined time upon application of a voltage in the primary transfer process.

In the image forming apparatus according to this invention, a satisfactorily transferred image can be transferred to a transfer material such as paper to form an image, and therefore the image quality is improved.

The transfer apparatus according to this invention described above uses a transfer belt having such an electric characteristic that a surge current of not less than a predefined value flows within a predetermined time upon application of a voltage in the primary transfer process. Therefore, the image transfer from the image forming units to the transfer belt is made possible by the action of the surge current flowing in the transfer nip. Even in the case where the image forming units and the position where the primary transfer process is executed are spaced from each other on the transfer belt, therefore, an image can be transferred satisfactorily.

The transfer apparatus according to this invention described above uses a transfer belt having such an electric characteristic that a surge current flows within a time predefined by the moving speed of the transfer belt and the contact width between the transfer belt and the image forming units. Therefore, an image can be transferred to the transfer belt by the action of the surge current flowing within the time to complete the transfer, i.e. within the transfer nip time. Even in the case where the image forming units and the position where the primary transfer process is executed are spaced from each other on the transfer belt, therefore, an image can be transferred satisfactorily.

In the transfer apparatus according to the invention described above, the primary transfer is conducted using such a transfer belt that a surge current flows within the time of 10 msec to 80 msec, or more preferably, several msec to several tens of msec upon application of a voltage in the primary transfer process. In the standard transfer process of an image forming apparatus employing the electrophotographic method, therefore, the image transfer can be completed by the action of the surge current flowing within the transfer nip time.

In the transfer apparatus according to the invention described above, the primary transfer is conducted using such a transfer belt that a surge current having a magnitude at least twice or four times as large as the steady current flows upon application of a voltage in the primary transfer process. Thus, the surge current flows along the surface and into the volume of the transfer belt, so that an image can be transferred satisfactorily by the action of the particular surge current.

In the transfer apparatus according to the invention described above, the conductive rollers are pressed in contact with the transfer belt in spaced relation with the contact area between the transfer belt and the image forming units. Thus, only the transfer belt is interposed between the conductive rollers and the image forming units, thereby reducing the contact pressure between the conductive rollers and the image forming units. As a result, the cohesion of the developing agent and the increased adhesion between the developing agent and the transfer belt is prevented, and an image can be transferred satisfactorily in the secondary transfer process.

The transfer apparatus according to the invention described above comprises a plurality of the image forming units, and the images formed by each of the image forming units are sequentially transferred to the transfer belt. A color image can be transferred, therefore, by setting each of the image forming units corresponding to the developing agent of different colors.

In the transfer apparatus according to the invention described above, the resistance value of the transfer belt is appropriately set, and therefore the transfer failure in the primary and secondary transfer processes can be suppressed, while at the same time eliminating the residual transfer potential.

In the transfer apparatus according to the invention described above, a transfer belt is formed using polyimide or polycarbonate in which a surge current of not less than a predefined value flows within the transfer nip time upon application of a voltage in the primary transfer process. Even in a transfer system in which the image forming units and the position where the primary transfer process is executed are arranged in spaced relation with each other, therefore, an image can be transferred by the action of the surge current flowing in the transfer belt.

In the image forming apparatus according to the invention described above, an image satisfactorily transferred can be transferred to a transfer material such as a paper to form an image, and therefore the image quality is improved.

The above and further objects and features of the invention will more fully be apparent from the following detailed description with accompanying drawings.

DETAILED DESCRIPTION OF THE PREFERRED EMBODIMENTS

This invention is explained specifically below with reference to the drawings showing preferred embodiments thereof.

Figure 1:
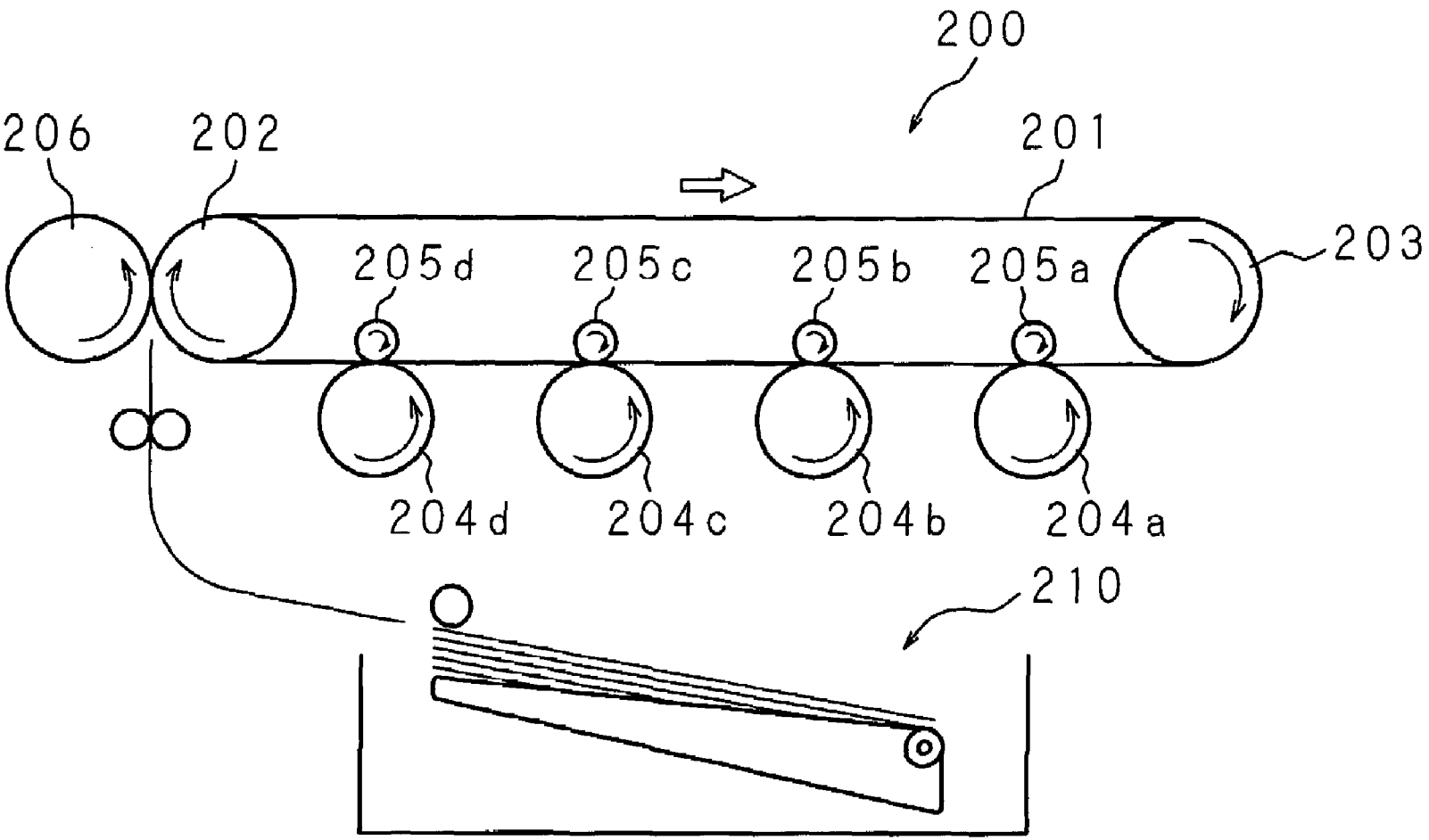
FIG. 1 PRIOR ART
FIG. 1 is a schematic diagram for explaining the configuration of the essential portion of the conventional full-color image forming apparatus employing the intermediate transfer method.
Figure 2:
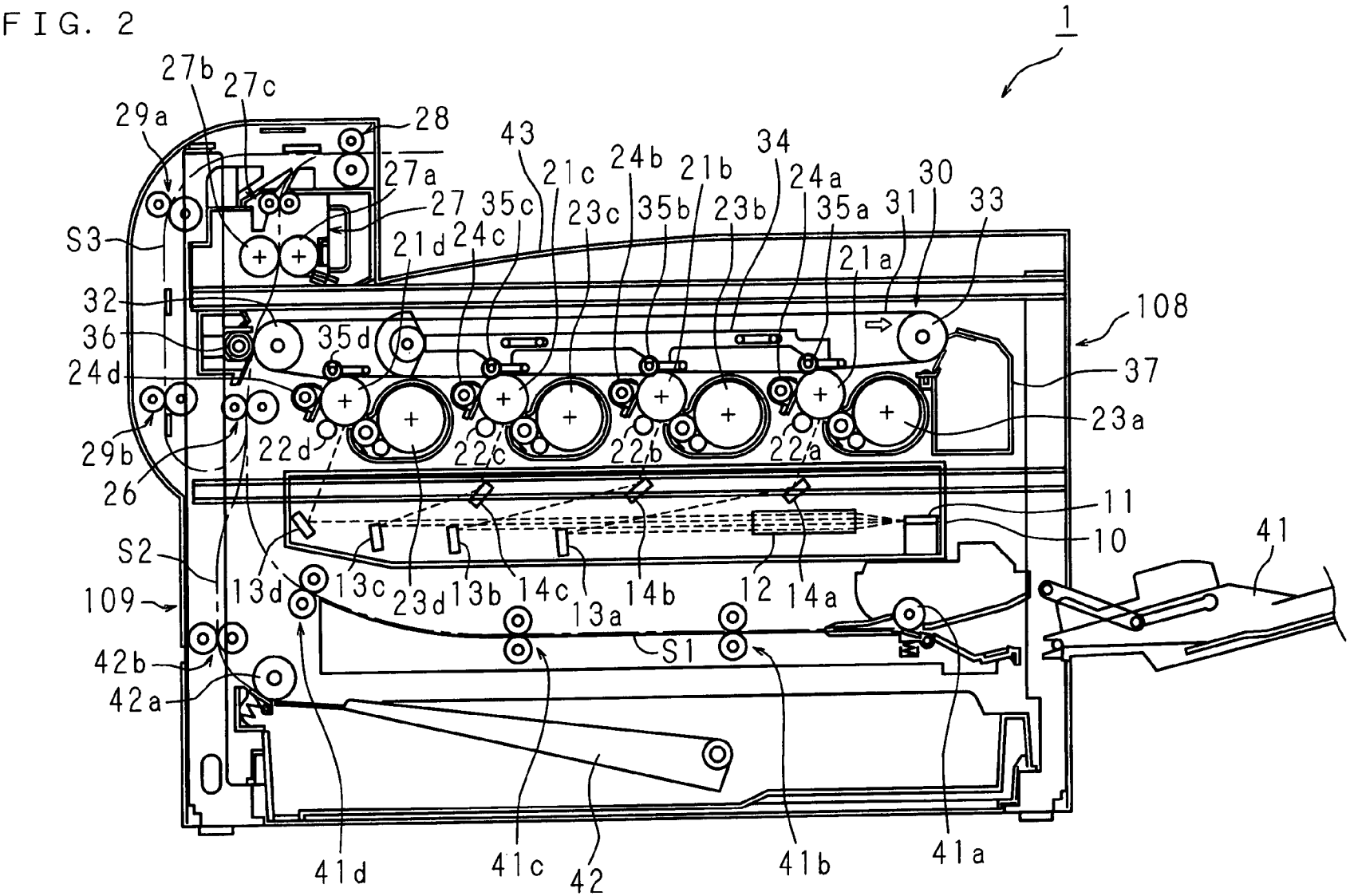
FIG. 2 is a schematic sectional view showing a general configuration of an image forming apparatus according to the invention.

FIG. 2 is a schematic sectional view showing a general configuration of the image forming apparatus according to this invention. In FIG. 2, reference numeral 1 designates an image forming apparatus according to the invention, or specifically, a digital color printer. The image forming apparatus 1 roughly comprises an image forming unit 108 and a paper feeding unit 109, wherein a multi-color image or a monochromatic image is formed on a paper (transfer material) based on the printing job data received from an information processing apparatus such as a personal computer (not shown) externally connected through a communication unit not shown.

The image forming apparatus 1 according to this invention comprises the image forming unit 108 of electrophotographic type. The image forming unit 108, to form a multi-color image using the colors of yellow (Y), magenta (M), cyan (C) and black (K), is configured of photosensitive drums 21*a*, 21*b*, 21*c*, 21*d*, chargers 22*a*, 22*b*, 22*c*, 22*d*, developing units 23*a*, 23*b*, 23*c*, 23*d* and cleaner units 24*a*, 24*b*, 24*c*, 24*d* for the respective colors, and an exposure unit 10 for forming an electrostatic latent image on the photosensitive drums 21*a*, 21*b*, 21*c*, 21*d* by emitting a laser beam based on the image data for printing.

The symbols a, b, c and d attached to the reference numerals correspond to the colors of yellow (Y), magenta (M), cyan (C) and black (K), respectively. Except in the case where a component corresponding to a specific color is designated and described, however, the components for each color are collectively referred to as photosensitive drum 21, a charger 22, a developing unit 23 and a cleaner unit 24.

The exposure unit 10 is configured of a laser scan unit (LSU) having a laser radiating unit 11. A polygon mirror 12 and reflection mirrors 13*a* through 13*d*, 14*a* through 14*c* are arranged to irradiate the photosensitive drum 21 with the laser beam emitted from the laser radiating unit 11. In place of the laser radiating unit 11, a write head including an array of light-emitting elements such as LED (light emitting diode) or EL (electro luminescence) may be used with equal effect.

The charger 22 is a roller type charger configured to contact the photosensitive drum 21 and uniformly charge the surface of the photosensitive drum 21 to a predetermined uniform potential. In place of the roller-type charger, a brush-type charger or charger-type charger may be used. The developing units 23*a* through 23*d* have stored therein the toner (developing agent) of yellow, magenta, cyan and black, respectively. The toner of each is supplied to the electrostatic latent image formed on the surface of the photosensitive drums 21*a* through 21*d* thereby to make a visible image from the toner image. The cleaner unit 24 recovers and remove the toner remaining on the surface of the photosensitive drum 21 after image transfer.

Also, the image forming apparatus 1 according to the invention is so configured that the toner image on the photosensitive drum 21 is transferred by the intermediate transfer method onto the paper supplied from the paper feeding unit 109. A transfer belt unit 30 providing a transfer apparatus according to the invention is arranged above the photosensitive drum 21. The transfer belt unit 30 includes a transfer belt, a transfer belt driving roller 32, a transfer belt driven roller 33, a transfer belt tension mechanism 34, and intermediate transfers rollers 35*a*, 35*b*, 35*c*, 35*d*. In the description that follows, the intermediate transfer rollers 35*a*, 35*b*, 35*c*, 35*d* are collectively referred to as the intermediate transfer roller 35.

The transfer belt driving roller 32, the transfer belt driven roller 33, the transfer belt tension mechanism 34, the intermediate transfer roller 35, etc. tension the transfer belt 31 on the one hand and rotate the transfer belt 31 in the direction of white arrow (in the direction of auxiliary scanning) in the drawing by the driving force of the transfer belt driving roller 32 on the other hand. The transfer belt 31 is formed in endless form using a film about 75 μm to 120 μm thick, and the surface thereof is in contact with the photosensitive drum 21. The toner images of the respective colors formed on the photosensitive drum 21 are transferred sequentially in superposed relation on the transfer belt 31, and thus a color toner image (multi-color toner image) is formed on the transfer belt 31. The transfer of the toner image from the photosensitive drum 21 to the transfer belt 31 is conducted by the intermediate transfer roller 35 in contact with the reverse side of the transfer belt 31. The intermediate transfer roller 35 is impressed with a high-voltage transfer bias for transferring the toner image, i.e. a high voltage of opposite polarity (+) to the charge polarity (−) of the toner. The intermediate transfer roller 35 has, as a base, a metal (stainless steel, for example) shaft 8 to 10 mm in diameter and has the surface thereof covered with a conductive elastic material such as foamed urethane or EPDM. Through this elastic material having conductivity, a high voltage is applied uniformly to the transfer belt 31 from the intermediate transfer rollers 35*a*, 35*b*, 35*c*, 35*d*.

As described above, the electrostatic image converted into a visible image corresponding to each color on the photosensitive drum 21 is superposed on the transfer belt 31, and an image for printing is reproduced on the transfer belt 31 as a multi-color toner image. The multi-color toner image transferred onto the transfer belt 31 in this way is transferred, by the rotation of the transfer belt 31, onto the paper by the transfer roller 36 arranged at a position where the paper is in contact with the transfer belt 31. In the process, the transfer belt 31 and the transfer roller 36 are pressed in contact with a predetermined nip, and at the same time, the transfer roller 36 is impressed with a voltage, i.e. a high voltage of opposite polarity (+) to the toner charge polarity (−) for transferring the multi-color image on the paper. In order to secure the nip steadily between the transfer belt 31 and the transfer roller 36, one of the transfer belt driving roller 32 and the transfer roller 36 is formed of a hard material such as metal, while the other roller is formed of a soft material such as elastic rubber or foamed resin.

The toner attached on the transfer belt 31 by contacting the photosensitive drum 21 or the toner remaining on the transfer belt 31 without transfer to the paper by the transfer roller 36 causes the color mixture of the toner in the next process, and therefore removed and recovered by the transfer belt cleaning unit 37 arranged in the vicinity of the transfer belt driven roller 33. The transfer belt cleaning unit 37 includes a cleaning blade (not shown) arranged in contact with the transfer belt 31.

The paper feeding unit 109 includes a manual tray 41 and a paper feed cassette 42 for containing the paper used for forming an image. The manual tray 41 is arranged externally to the housing of the image forming apparatus 1. Only a few number of sheets of paper of the type desired by the user are placed on the manual tray and adapted to take into the image forming apparatus 1. The paper feed cassette 42, on the other hand, is arranged under the image forming unit 108 and the exposure unit 10 to contain a great amount of paper of the size specified by the apparatus or predetermined by the user. The sheets of paper placed on the manual tray 41 are taken into the apparatus by the pickup roller 41*a* at a timing designated by the operating panel (not shown) of the image forming apparatus 1, and conveyed to the image forming unit 108 by the conveyor rollers 41*b*, 41*c* 41*d* arranged along the paper conveyance path S1. Also, the papers contained in the paper feed cassette 42 are fed one by one by the pickup roller 42*a* and conveyed to the image forming unit 108 through the conveyor roller 42*b* arranged along the paper conveyance path S2.

A register roller 26 is arranged under the transfer roller 36 and the transfer belt driving roller 32. The register roller 26 conveys the paper to the transfer roller 36 at a timing when the forward end of the paper conveyed from the paper feeding unit 109 comes into registry with the forward end of the toner image on the transfer belt 31, thereby transferring the toner image from the transfer belt 31 onto the paper.

The paper to which the toner image is transferred is conveyed substantially vertically and reaches a fixing unit 27 arranged above the transfer roller 36. The fixing unit 27 includes a heating roller 27*a* and a pressure roller 27*b*. By controlling the heating means such as a heater lamp based on the detection value of a temperature sensor not shown, the heating roller 27*a* is maintained at a predetermined fixing temperature. At the same time, the paper to which the toner image has been transferred is rotated while being held between the heating roller 27*a* and the pressure roller 27*b*. In this way, the toner image is thermally fixed on the paper by the heat of the heating roller 27*a*. The thermally fixed paper is delivered by the conveyor roller 27*c* arranged in the neighborhood of the outlet of the fixing unit 27.

The paper that has passed through the fixing unit 27, when one-side printing is required, is delivered face down on a discharge tray 43 through a discharge roller 28. In the case where the two-side printing is required, on the other hand, the paper is chucked by the discharge roller 28, led to the two-side paper conveyance path S3 by reverse rotation of the discharge roller 28, and conveyed to the register roller 26 again by the conveyor rolls 29*a*, 29*b*. After the toner image is transferred to and thermally fixed on the reverse side of the paper, the paper is delivered onto the discharge tray 43 by the discharge roller 28.

Figure 3:
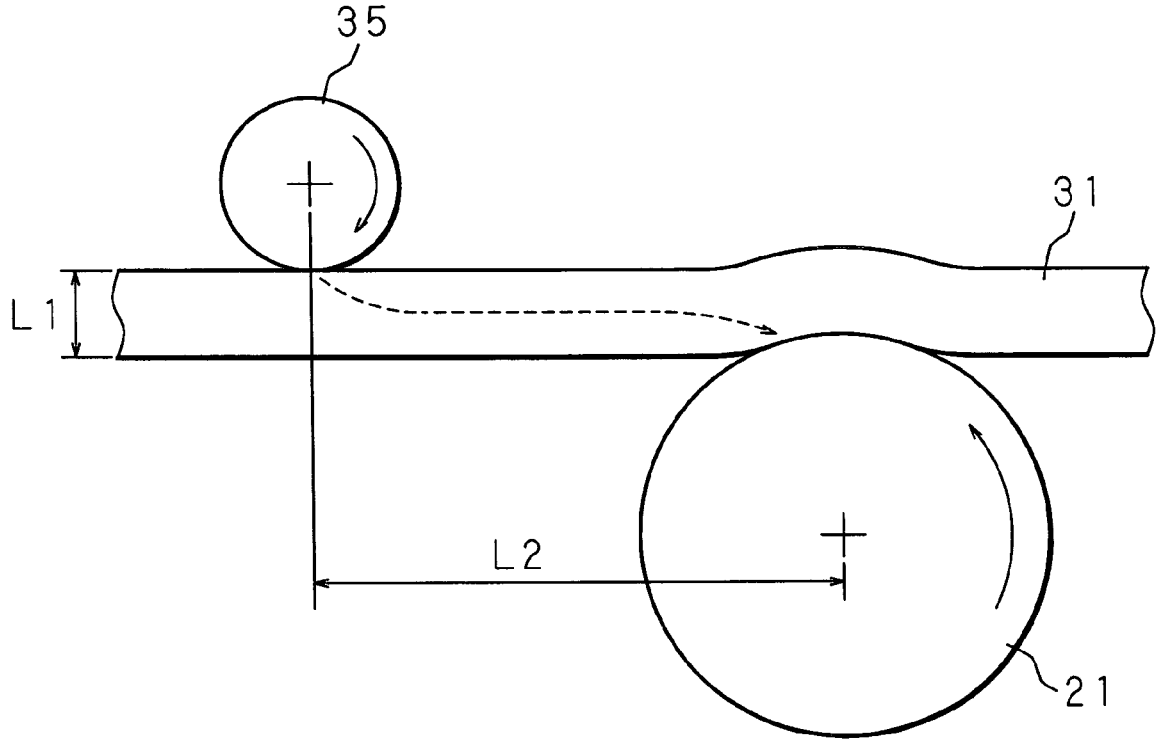
FIG. 3 is an enlarged schematic diagram showing the neighborhood of the photosensitive drum of an image forming apparatus according to the invention.

The configuration of the essential portion in the neighborhood of the photosensitive drum 21 is explained bellow. FIG. 3 is an enlarged schematic diagram showing the neighborhood of the photosensitive drum 21. The photosensitive drum 21 is arranged along the outer peripheral surface of the transfer belt 31, and rotatably supported by a shaft while pressing the transfer belt 31 upward. The intermediate transfer roller 35 is arranged along the inner peripheral surface of the transfer belt 31, and rotatably supported by a shaft while pressing the transfer belt 31 downward. The photosensitive drum 21 and the intermediate transfer roller 35 are both rotated in the forward direction of movement of the transfer belt 31 and have the respective rotational shafts in parallel with each other. The image forming apparatus 1 according to this invention has the feature that the rotational shaft of the intermediate transfer roller 35 is offset from the rotational shaft of the photosensitive drum 21 in the direction of movement of the transfer belt 31. As a result, the photosensitive drum 21 and the intermediate transfer roller 35 have no common contact area with the transfer belt 31, and only an area exists between them where only the transfer belt 31 is interposed. For this reason, in the primary transfer process of the image forming apparatus 1 according to the invention, the transfer is made possible while controlling the contact pressure at low level between the photosensitive drum 21 and the transfer belt 31. Therefore, the cohesion of the toner onto the transfer belt 31 is prevented, and an image is satisfactorily formed in the secondary transfer process.

In such transfer system, the positional relation of the photosensitive drum 21 and the intermediate transfer roller 35 are determined taking the driving performance and endurance of the transfer belt 31 and the contact pressure between the photosensitive drum 21 and the transfer belt 31 into consideration. The horizontal distance L2 between them is often set at about several mm generally to meet the conditions described above. This value is greater by the order of about one digit than the thickness L1 (75 μm to 120 μm) of the transfer belt 31. It is therefore necessary to determine the electric characteristics of the transfer belt 31 taking into account the current component flowing along the surface as well as the current component flowing into the volume, of the current flowing in the transfer belt 31 upon application of a transfer voltage to the intermediate transfer roller 35. Specifically, the material of the transfer belt 31 is determined not merely along the guideline about the electric resistance as in the prior art but along a new guideline considering the change characteristic of the current flowing in the transfer belt 31 as well.

Figure 4:
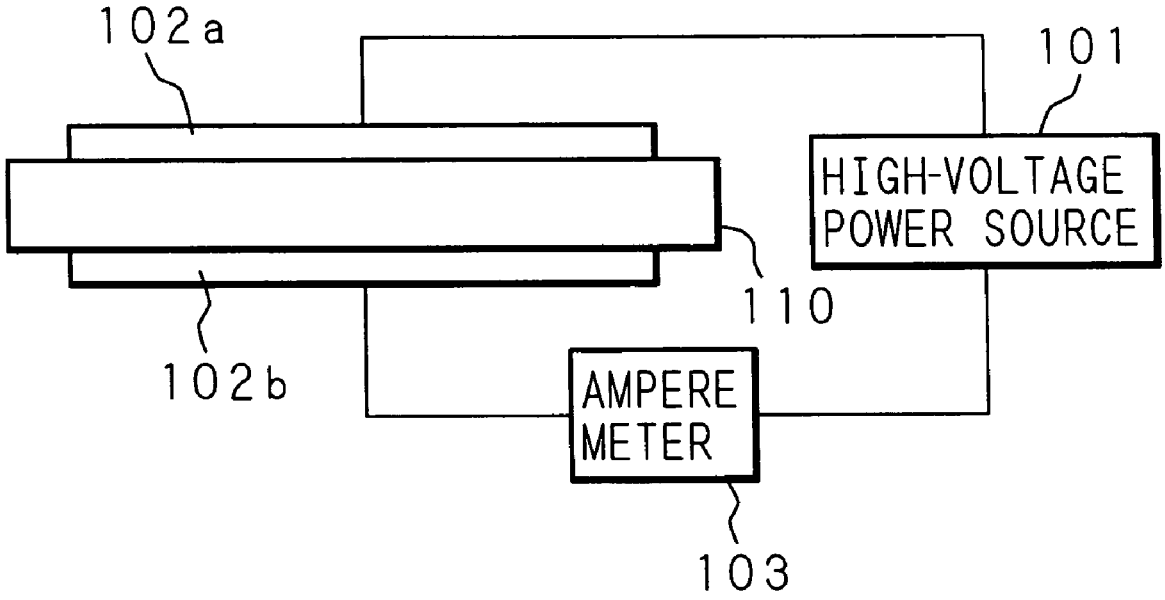
FIG. 4 is a schematic diagram showing a configuration of a measuring system for observing the electric characteristics of the transfer belt.
Figure 5:
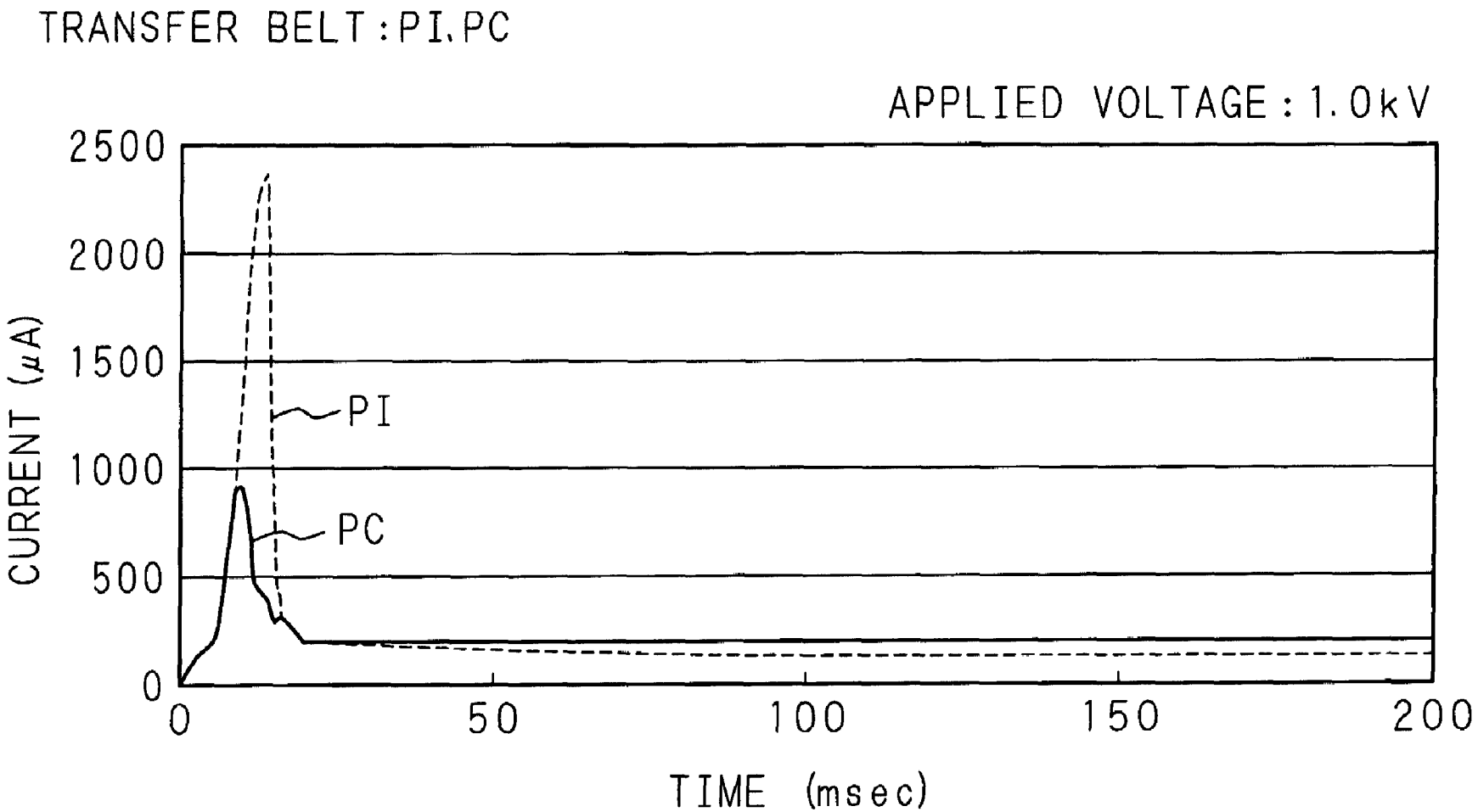
FIG. 5 is a graph showing the change characteristic of the current flowing in the transfer belt.
Figure 6:
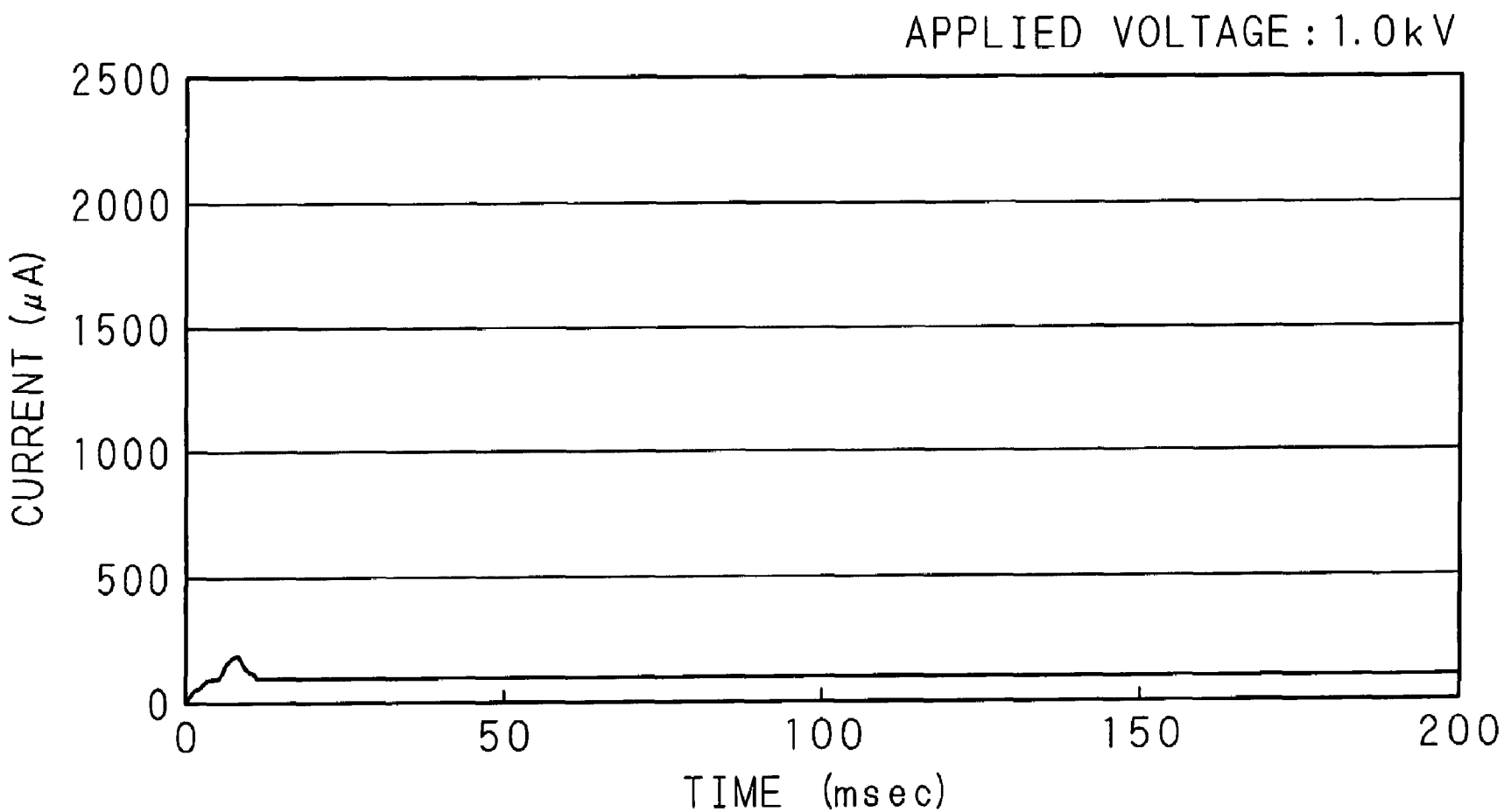
FIG. 6 is a graph showing the change characteristic of the current flowing in the transfer belt.

The result of the study conducted by the present inventors is explained. FIG. 4 is a schematic diagram showing a configuration of a measuring system for observing the electric characteristics of the transfer belt 31. FIG. 5 and FIG. 6 are graphs showing the change characteristic of the current flowing in the transfer belt 31. The electric characteristics of the transfer belt 31 are acquired by the observation system as shown in FIG. 4. Specifically, the belt material 110 of polyimide, polycarbonate or polyamide alloy is pinched by tabular poles 102*a*, 102*b*, and a voltage is applied between the poles 102*a* and 102*b* from a high-voltage power source 101. The time series variation of the current is observed and acquired by an ampere meter 103.

FIG. 5 shows the result of observation for the belt material 110 of polyimide (PI) or polycarbonate (PC). The abscissa represents the time (msec) and the ordinate the current value (μA). The applied voltage is assumed to be 1.0 kV. As shown in the graph of FIG. 5, a large surge current flows in the belt material 110 of polyimide or polycarbonate immediately after voltage application (upon lapse of several tens of msec), followed by a steady state. It is understood that the magnitude of the surge current for polyimide is about ten and several times as large as the steady current and the counterpart for polycarbonate about five times as large as the steady current. On the other hand, FIG. 6 shows the result of observation in the case where the belt material 110 is polyamide alloy (PAA). The conditions for observation are the same as those in FIG. 5. The abscissa represents the time (msec), and the ordinate the current value (μA), with the applied voltage of 1.0 kV. In the case where a polyamide alloy is used, the surge current observed immediately after voltage application is not more than twice the steady current. As far as polyamide alloy is concerned, therefore, the surge current is considerably smaller than for polyimide or polycarbonate.

The result of studying the toner transfer performance using the transfer belt 31 formed of these materials shows that stable toner transfer is impossible with polyamide alloy while satisfactory transfer can be achieved with polyimide and polycarbonate. These materials have substantially the same resistance value and about the same current flows in them in steady state. Therefore, the action of the steady current is hardly considered to have any effect, favorable or unfavorable, on the toner transfer. In fact, the transfer nip time is very short in the actual transfer system. In the case where the moving speed of the transfer belt 31 is 125 mm/sec and the nip width is 7 mm, for example, the transfer nip time is 56 msec. In the transfer system shown in FIG. 3, therefore, the surge current flowing during the transfer nip time is considered to have an effect on the toner transfer. It is concluded, therefore, that for a satisfactory toner image to be transferred, a comparatively large surge current is required to flow through the transfer belt within several tens of msec from the time of voltage application. In other words, a predetermined level of transfer efficiency can be secured and the image quality can be improved by the transfer belt 31 made of any material including polyimide and polycarbonate in which a large surge current is observed during the transfer nip time.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A transfer apparatus which comprises a transfer belt having conductivity and an image forming unit pressed against said transfer belt to form an image using charged developing agent, and to transfer the image formed by said image forming unit to said transfer belt by applying a voltage to said image forming unit through said transfer belt in a primary transfer process, and further to transfer the image transferred in said primary transfer process to a transfer material in a secondary transfer process, while said transfer belt is made to move in a predetermined direction, wherein said transfer belt has such electric characteristics that a surge current of not less than a predefined value flows within a predetermined time upon application of a voltage in said primary transfer process, said predetermined time being specified by the moving speed of said transfer belt and a contact width in said predetermined direction between said transfer belt and said image forming unit so as to be not less than 10 msec and not more than 80 msec, and said predefined value being twice or more as large as a current flowing in said transfer belt after said predetermined time.

2. The transfer apparatus according to claim 1, comprising a plurality of image forming units;

wherein the images formed by each of said image forming units are sequentially transferred to said transfer belt and superposed one on another thereby to form a single image on said transfer belt.

3. The transfer apparatus according to claim 2, wherein the resistance value of said transfer belt is not less than $1\times10^{8}$ Ω but not more than $1\times10^{14}$ Ω.

4. The transfer apparatus according to claim 3, wherein said transfer belt is formed of polyimide or polycarbonate.

5. The transfer apparatus according to claim 1, wherein said primary transfer process is a process for applying a voltage to a conductive roller pressed in contact with said transfer belt in spaced relation with the contact area between said transfer belt and said image forming unit.

6. The transfer apparatus according to claim 5, comprising a plurality of image forming units;

wherein the images formed by each of said image forming units are sequentially transferred to said transfer belt and superposed one on another thereby to form a single image on said transfer belt.

7. The transfer apparatus according to claim 6, wherein the resistance value of said transfer belt is not less than $1\times10^{8}$ Ω but not more than $1\times10^{14}$ Ω.

8. The transfer apparatus according to claim 7, wherein said transfer belt is formed of polyimide or polycarbonate.

9. An image forming apparatus comprising:

a communication unit for receiving image data from external apparatuses; and a transfer apparatus which comprises a transfer belt having conductivity and an image forming unit pressed against said transfer belt to form an image using charged developing agent, and to transfer the image formed by said image forming unit based on the image data received by said communication unit to said transfer belt by applying a voltage to said image forming unit through said transfer belt in a primary transfer process, and further to transfer the image transferred in said primary transfer process to a transfer material in a secondary transfer process, while said transfer belt is made to move in a predetermined direction, wherein said transfer belt has such electric characteristics that a surge current of not less than a predefined value flows within a predetermined time upon application of a voltage in said primary transfer process, said predetermined time being specified by the moving speed of said transfer belt and a contact width in said predetermined direction between said transfer belt and said image forming unit so as to be not less than 10 msec and not more than 80 msec, and said predefined value is twice or more as large as a current flowing in said transfer belt after said predetermined time.

10. The image forming apparatus according to claim 9, wherein said transfer apparatus comprising a plurality of image forming units; and the images formed by each of said image forming units are sequentially transferred to said transfer belt and superposed one on another thereby to form a single image on said transfer belt.

11. The image forming apparatus according to claim 10, wherein the resistance value of said transfer belt is not less than $1\times10^{8}$ Ω but not more than $1\times10^{14}$ Ω.

12. The image forming apparatus according to claim 11, wherein said transfer belt is formed of polyimide or polycarbonate.

* * * * *